United States Patent [19]

Chevalier

[11] Patent Number: 4,863,428

[45] Date of Patent: Sep. 5, 1989

[54] INJECTING PROJECTILE DART

[75] Inventor: Martin A. Chevalier, Lake Elmo, Minn.

[73] Assignee: BallistiVet, Inc., White Bear Lake, Minn.

[21] Appl. No.: 173,134

[22] Filed: Mar. 24, 1988

[51] Int. Cl.[4] ..... A61M 5/20

[52] U.S. Cl. ..... 604/130; 604/135; 604/239; 102/512; 273/418

[58] Field of Search ..... 604/117, 130, 134, 135, 604/239, 240, 243, 272; 102/512; 273/418

[56] References Cited

U.S. PATENT DOCUMENTS

| | | | |
|---|---|---|---|
| 1,815,300 | 7/1931 | Harris | 604/130 |
| 2,348,337 | 5/1944 | Francis | 102/92 |
| 2,512,568 | 6/1950 | Saffir | 604/272 |
| 2,620,190 | 12/1952 | Bean | 273/418 |
| 2,854,925 | 10/1958 | Crockford | 102/92 |
| 3,022,785 | 2/1962 | Crockford | 102/92 |
| 3,207,157 | 9/1965 | Murdoch | 604/130 |
| 3,209,695 | 10/1965 | Crockford | 102/92 |
| 3,209,696 | 10/1965 | Palmer | 102/92 |
| 3,386,381 | 6/1968 | Ferb | 102/92 |
| 3,457,921 | 7/1969 | Waldeisen | 604/130 |
| 3,715,990 | 2/1973 | Palmer | 102/92 |
| 4,103,893 | 8/1978 | Walker | 273/106 |
| 4,383,530 | 5/1983 | Bruno | 604/274 |
| 4,735,612 | 4/1988 | Chevalier | 604/130 |

OTHER PUBLICATIONS

Vos, van Rooyen and Kloppers, Anthrax Immunization of Free-Ranging Roan Antelope Hipportragus Equinus in the Kruger National Park, Koedoe, 16:11-25 (1973).

*Primary Examiner*—Stephen C. Pellegrino
*Assistant Examiner*—Ralph Lewis
*Attorney, Agent, or Firm*—Merchant, Gould, Smith, Edell, Welter & Schmidt

[57] ABSTRACT

An injecting dart having an improved barb design and aerodynamics is disclosed. The dart (10) preferably includes a stainless steel needle (12), and a body having a forward section (14) and a tail section (16). A narrow shaft (11) contains and supports the needle (12). The shaft (11) includes an integral, circumferential barb (24) which maintains the dart (10) in the hide of the animal until the dart's contents are fully discharged. The tail section (16) includes several fins (17) to improve aerodynamics, and a plurality of vent holes (38) to permit free movement of the dart's piston, thereby ensuring complete and rapid delivery of the liquid to the animal.

16 Claims, 2 Drawing Sheets

FIG. 1
PRIOR ART
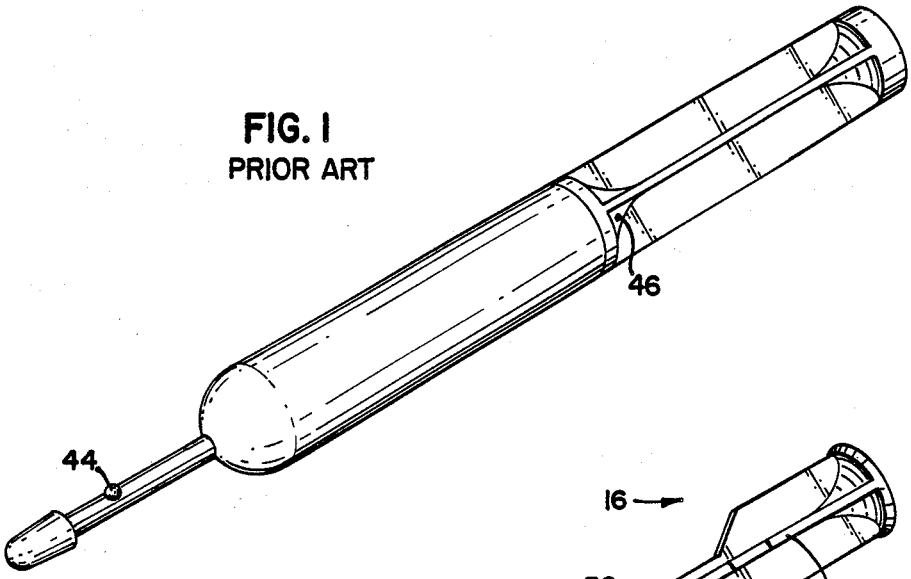
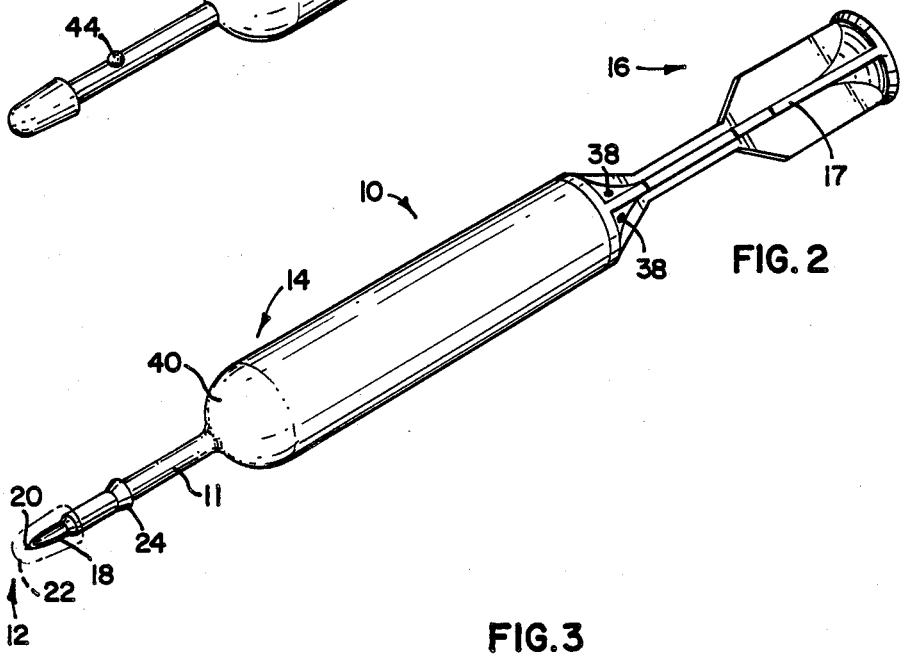
FIG. 2
FIG. 3
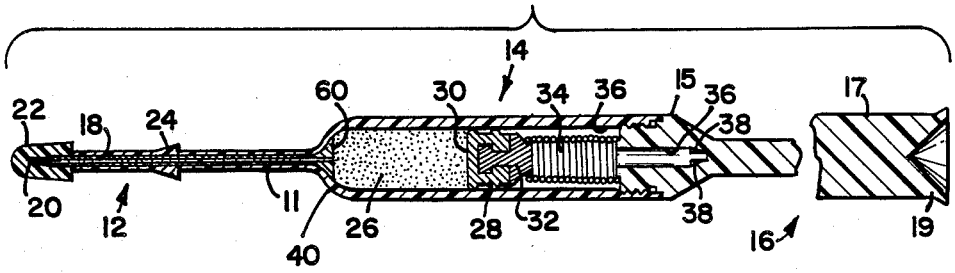

FIG. 4
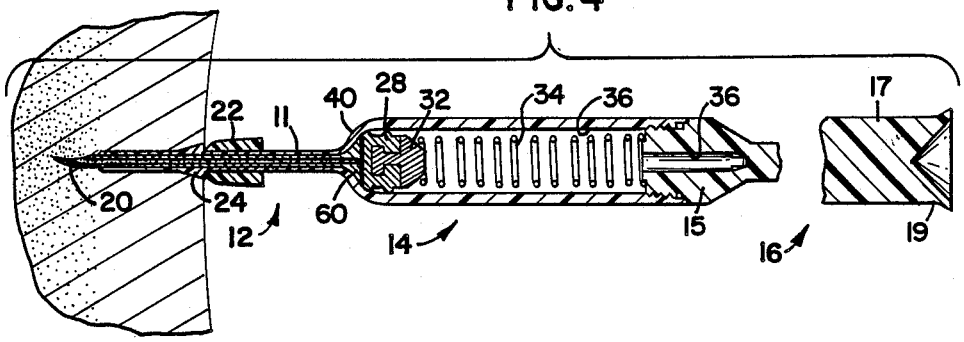
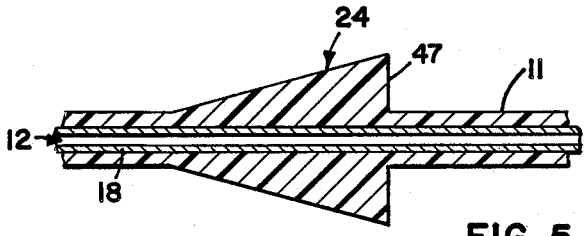
FIG. 5

INJECTING PROJECTILE DART

FIELD OF THE INVENTION

This invention generally relates to projectiles for the injection of a liquid into an animal located at a distance, nnd more particularly to an injecting dart which is constructed to minimize tissue trauma. This patent application is related to Applicant's pending patent application, Serial No. 903,259, filed September 3, 1986, for "Trauma Minimizing Dart".

BACKGROUND OF THE INVENTION

Various types of projectiles which can be fired at an animal from a distance and which on impact inject a liquid through a needle into the animal have been proposed. The liquid, e.g., liquid tranquilizer, is typically stored in a cylindrical "primary chamber" within the projectile. One side of a movable piston or the like is typically in contact with the liquid within the primary chamber. The opposite side of the piston faces a "secondary chamber" which includes means for driving the piston toward the primary chamber. Movement of the piston toward the primary chamber pressurizes the liquid and causes it to flow through the needle into the animal.

Unfortunately, most prior art hypodermic projectiles cause considerable damage to animals. They damage outer tissue, including hide, upon impact; then they damage inner tissue layers when they violently dispense their liquid contents.

Several characteristics of prior art hypodermic projectiles contribute to their tendency to cause tissue damage. For example, many existing injecting or hypodermic projectiles include relatively aggressive triggering mechanisms for releasing the liquid from the primary chamber after the projectile strikes its target. Some projectiles include a chemical charge in the secondary chamber which explodes upon impact to drive the piston toward the primary chamber, whereas other projectiles include pressurized secondary chambers, wherein the secondary chamber is pressurized prior to firing of the dart or as a result thereof. When the needle strikes and penetrates the animal, the primary chamber is placed in fluid communication with the hollow needle and the pressurized secondary chamber causes the piston to rapidly push the liquid through the needle and into the animal.

Experience has shown that there are problems associated with a pressurized secondary chamber, whether the pressure is due to chemical explosion or a compressed gas. For example, it is very difficult to guarantee that the secondary chamber will be properly pressurized in all cases. If the secondary chamber is insufficiently pressurized, the piston separating the primary and secondary chambers will be unable to force the entire contents of the primary chamber through the needle. On the other hand, if the secondary chamber is overly pressurized, the liquid in the primary chamber will rapidly spurt through the needle. This can damage the animal's tissue. In fact, "gas-propelled" pistons can inject liquid into an animal at such an explosive rate that the liquid literally bores a hole in the animal's tissue. The volume of liquid injected (approximately 2 to 4 cc) is large enough to cause considerable trauma to the animal's tissue. Tissue trauma can also be caused simply by the impact of a dart; this problem is discussed below.

In addition to the secondary chamber problem discussed above, prior art injecting projectiles typically have inadequate barbs. A barb is defined herein as any type of lateral protrusion on the penetrating needle which helps retain the needle within the animal during the liquid injection process.

Barbs are typically prefabricated and attached to dart needles in separate assembly operations. U.S. Pat. Nos. 3,209,695 and 3,209,696 show darts having such prefabricated barbs. While the use of prefabricated barbs can be cost effective, it is perceived that this technique can create problems. For example, the bond between the barb and the needle might fail, in which case the barb will not help retain the needle within the animal. If the tip of the needle does not remain in the animal's muscle for a sufficiently long period of time, some of the liquid could be deposited within the fatty subcutaneous layer immediately beneath the animal's hide or otherwise wasted. And, if the barb should become disconnected from the needle when the needle and barb are in the animal, the barb could remain in the animal when the needle is withdrawn, potentially harming the animal.

Also, a prefabricated barb could be improperly attached to its needle. For example, a prefabricated barb could be attached backwards, such that its biting edge or lip is toward the tip of the needle. A backwards barb could obviously cause unnecessary damage to an animal. In addition, a backwards barb would not assist in retaining the needle in an animal during the injection process.

Aside from the problems associated with bonding the barb to the needle, some barbs are overly "aggressive." An overly aggressive barb can be defined as one which extends laterally from the needle to an excessive extent or which is shaped to hook an animal's hide, making removal difficult. If a barb is too aggressive, it will retain the needle within the animal for an unnecessarily long period of time. The needle need only be within the animal for a period of time sufficient to allow transfer of the contents of the primary chamber into the animal.

In addition, most prior art hypodermic projectiles are excessively costly and so complex as to be too heavy for accurate long range injections. The weight of prior art hypodermic projectiles is particularly troublesome. Unfortunately, the heavier the dart, the greater the trauma to the animal occasioned simply by the momentum of the dart. Animals which are inoculated, for example, with prior art projectiles almost invariably suffer a hematoma at the dart's entry point.

Thus, while prior art hypodermic projectiles are generally useful for their intended purposes, as a class they possess several shortcomings. In summary, they often include complicated trauma-producing triggering mechanisms, disadvantageous barbs and heavy components which can cause impact damage to the animal.

A projectile which addresses most of the problems discussed above is shown in FIG. 1. This projectile, developed by G. L. van Rooyen, includes a simple compression spring in its secondary chamber and does not rely on a pressurized secondary chamber. A small hole 46 vents the secondary chamber to the atmosphere. The single small vent hole 46 allows the spring to freely compress as the primary chamber is loaded and permits the piston to controllably and fully discharge the contents of the primary chamber upon impact of the dart.

Further with regard to the basic van Rooyen dart shown in FIG. 1, the liquid is initially loaded into the primary chamber through the needle. As the primary chamber fills, the piston moves toward the secondary chamber and the spring compresses. Once the primary chamber is filled, the tip of the needle is capped. Alternatively, the piston is placed in a preselected position so as to establish, for example, a 2 cc primary chamber volume; the primary chamber is filled; the needle is capped; and a compressed spring is positioned behind the piston within the secondary chamber to pressurize the primary chamber. In either event, when the projectile strikes an animal, the needle penetrates the resilient cap and the animal's hide, and the pressurized liquid in the primary chamber flows through the needle into the animal in a controlled manner. This controlled delivery of liquid eliminates the tissue damage associated with high flow and high pressure delivery by gas-powered pistons. In addition, the primary and secondary chambers of the basic van Rooyen dart are made of plastic, resulting in a dart which is lighter than earlier described darts. Thus, impact-related tissue damage is reduced.

While the basic van Rooyen dart addresses many of the shortcomings of prior art injecting darts, it is perceived that it can be improved. In particular, the present invention is directed toward improving the barb and needle structure of the basic van Rooyen dart. Preferred embodiments of the dart of the present invention are considerably lighter than the van Rooyen dart, resulting in less impact-related tissue damage.

With regard to the barb, the basic van Rooyen dart (shown in FIG. 1) has a barb which consists of a drop of silver solder 44 on the barrel of the needle. Besides involving an expensive and time-consuming manufacturing process, it is perceived that there are potential problems associated with the difficulty of closely controlling the size, shape and bonding integrity of the solder drop 44. If the drop 44 is too small, the needle can fall out of the animal prior to delivery of the entire contents of the primary chamber. In fact, the delivery of the liquid alone could supply sufficient rearward pressure on the needle to cause it to fall out of the animal's hide if the barb 44 is insufficiently aggressive.

On the other hand, if the barb 44 on the basic van Rooyen dart is too pronounced the needle can remain in the animal for a period of time after the liquid has been injected. Further, if the drop 44 is too large it can affect the flight aerodynamics of the dart due to asymmetrical wind loading and due to the inherent imbalance created by the solder drop 44.

As in the case of prefabricated barbs discussed above, the solder drop 44 could disconnect from the needle in which case the needle could prematurely fall out of the animal's hide and the solder drop 44 could remain within the animal. The solder drop 44 could fall off the needle at the time of firing; upon impact with the animal; or simply while the dart is being handled prior to firing.

Finally, the solder drop 44 could easily be longitudinally mislocated on the needle. The location and size of a barb 44 affect the dart's balance which in turn affects the flight of the dart. If the barb 44 is too large and too close to the needle's tip, the front end of the dart will be too heavy in comparison to the tail, and the dart will tend to prematurely dive during flight. Conversely, if the barb 44 is too small and too close to the root of the needle, the dart will tend to climb to a surprising degree.

The size and shape of the barb also directly affect the aerodynamics of the dart by virtue of the fact that the barb is mounted near the tip of the needle. For example, if the barb is excessively large, protruding laterally from the barrel of the needle, unnecessary drag will result and the dart's range will be decreased. It is perceived that the solder drop 44 of the basic van Rooyen dart causes an asymmetrical, erratic wind loading on the dart during flight.

The present invention addresses these and many other problems associated with currently available injecting projectile darts.

SUMMARY OF THE INVENTION

The present invention comprises a dart for injecting a liquid into an animal. The dart has a hollow body with a forward section and a tail section. The forward section of the body includes a narrow shaft portion having a circumferential and substantially annular barb thereon. A hollow needle is in operative contact with the shaft portion.

In the preferred embodiment, the needle is press fit into the shaft portion of the dart body. The barb is provided to maintain the dart within the animal's hide until the full dosage of liquid is discharged. Preferably, the barb is of unitary, one piece construction with the shaft portion of the dart body.

The dart body includes a plurality of longitudinal fins to enhance aerodynamic performance. Within the dart body is a slidable piston, with the front face of the piston defining a primary chamber suitable for containing the liquid to be injected, and the rear face of the piston defining a secondary chamber. Resilient means are provided for urging the piston toward the primary chamber when the needle enters the animal so as to force the liquid through the needle into the animal.

According to other aspects of the invention, vent holes are formed in the tail section of the dart body so as to permit unrestricted movement of the piston. The preferred dart also includes a needle which has a curved tip to prevent plugging of the needle as it enters the animal. In the preferred embodiment, the needle is made of stainless steel. Preferably, the entire forward section of the dart, including the shaft portion and integral barb, are made of a plastic material and are of unitary construction.

The dart of the present invention includes a barb which is substantially symmetrical with respect to the barrel of the needle. In addition, the barb's location, size and weight can be closely controlled. The barb of the present invention is an integral part of the dart body itself, and the fabrication of the barb can easily be automated. Thus the location of the barb and its shape and size can be closely controlled.

The present invention is advantageous in that the dart effectively penetrates the animal. The design of the needle tip and the stainless steel construction of the needle enhances strength and rigidity of the dart. Further, the needle is securely and rigidly attached to the shaft portion of the dart. In the preferred embodiment, this attachment is accomplished by press fitting the needle within the shaft portion, with the needle extending a sufficient distance within the supporting shaft portion. This needle and barb design also prevents the needle from becoming accidently disconnected from the dart body.

Another feature of the present invention is that the dart is constructed to minimize tissue trauma. The needle design results in a smaller hole in the animal's hide, thereby resulting in less damage to the animal's outer tissue upon impact. Preferred embodiments of injecting projectiles constructed according to the present invention are also considerably lighter than prior art projectiles, including the basic van Rooyen dart. As discussed above, lighter darts cause less tissue trauma to animals. Thus, the barb design of the present invention minimizes trauma and does not cause unnecessary damage to the animal.

In addition, the barb of the present invention effectively maintains the dart within the animal's body until the liquid has been fully injected. This assures that a full dosage is received. However, the barb is not overly aggressive, so that the dart of the present invention can be easily removed from the animal.

Yet another advantage of the present invention is that it is simple in construction, easy to manufacture, and relatively low in cost.

For a better understanding of the invention, and of the advantages obtained by its use, reference should be made to the Drawings and accompanying descriptive matter in which there is illustrated and described a preferred embodiment of the invention.

BRIEF DESCRIPTION OF THE DRAWINGS

In the Drawings, which form a part of the instant specification and are to be read in conjunction therewith, an optimum embodiment of the invention is shown and, in the various views, like numerals are employed to indicate like parts.

FIG. 1 is a perspective view of a prior art dart;

FIG. 2 is a perspective view of the dart according to the present invention;

FIG. 3 is a longitudinal sectional view of the dart of FIG. 2, showing a charged primary chamber and a capped needle;

FIG. 4 is a longitudinal sectional view of the dart of FIGS. 2 – 3 in the discharged position; and FIG. 5 is an enlarged sectional view of the barb utilized in conjunction with the dart of the present invention.

DETAILED DESCRIPTION OF THE PREFERRED EMBODIMENT

Referring to the Drawings, wherein like reference numerals represent like parts and assemblies throughout the several views, FIG. 2 shows a perspective view of a dart 10 according to the present invention. The dart 10 includes three basic components: a needle 12, a forward section 14 and a tail section 16.

As shown in FIGS. 2 and 3, needle 12 includes a standard hollow needle barrel 18. In the preferred embodiment, the needle barrel 18 is made of stainless steel. The barrel 18 is beveled at its forwardmost end to form a sharp tip 20. The tip 20 may be bent inward slightly to form a protective hood over the core of the needle 18, as shown in the preferred embodiment illustrated. This tip 20 is normally enclosed by a resilient cap 22 as further described below.

The forward section 14 of the dart 10 includes a narrow shaft portion 11 proximate the needle 12. The needle 12 is inserted within the shaft 11 for secure attachment and further support of the needle 12. The shaft 11 is preferably integral and of unitary construction with the main body of the forward section 14, with both the forward section 14 and shaft 11 being made of a plastic material in the preferred embodiment. A curved intermediate portion 40 is located between the narrow shaft portion 11 and the main cylindrical portion of the forward section 14. The shaft 11 and forward section 14 are preferably molded as a single piece using conventional injection molding, but other fabrication techniques are contemplated.

The needle 12 is press fit within the shaft 11 for a secure interconnection in the preferred embodiment. The needle 12 could also be connected to the shaft 11 using a conventional adhesive, or a combination of the adhesive and press fit techniques. Alternatively, the shaft 11 could be injection molded around the root of the needle 12 so as to securely connect the two parts together.

Both the inside and outside of the support shaft 11 have a generally circular cross-section. Proximate the rear end of the shaft 11 and the curved portion 40 is a shoulder 60 within the dart body. The rear end of the needle 12 abuts the shoulder 60 when the needle 12 is inserted and positioned within the shaft 11. The needle 12 extends a relatively substantial distance inside the shaft portion 11 of the dart body, with the shorter tip portion 20 being exposed. In the preferred embodiment, the needle 12 is approximately 1.25 inches long, with its rear end terminating near the curved portion 40 in the preferred embodiment. In this manner, the shaft portion 11 provides substantial support and rigidity to the needle 12 and minimizes the potential for the needle 12 to become disconnected or bent.

The shaft portion 11 includes a barb 24, with the barb 24 preferably being substantially annular, and circumferential in shape. As illustrated in the enlarged view of FIG. 5, the barb diameter tapers gradually outward near the rear end of the barb 24. The rear end of the barb 24 has a lip 47 which prevents the dart 10 from becoming prematurely dislodged. This shape of the barb 24 minimizes tissue damage and trauma to the animal, yet provides a sufficient mechanism for securing the dart 10 within the animal hide, as shown in FIG. 4. Preferably, the barb 24 is formed by an injection molding process.

The barrel of the needle preferably has an outside diameter of approximately 0.065 inch and an inside diameter of approximately 0.047 inch. The barb preferably extends radially or laterally between approximately 0.001 inch and 0.10 inch from the outside diameter of the shaft 11. It is to be understood that different sized needles and barbs could be constructed for particular applications according to the teachings of the present invention.

The sections 14 and 16 of dart 10 are preferably injection molded plastic and are threaded together. While plastics such as cellulose-acetate-butyrate, polyester, polycarbonate, polypropylene and polyethylene could be used, the preferred material is a nylon. The forward section 14 contains the moving components which discharge the liquid through the needle 12 once it penetrates an animal's hide, whereas the tail section 16 is primarily included to counterbalance the forward section 14 and to provide flight stability.

As shown in FIG. 3, the core of the needle 12 is in fluid communication with a primary chamber 26 formed by the forward section 14. The rearmost end of the primary liquid chamber 26 is formed by a movable piston 28. The piston 28 is preferably made of a resilient material such as rubber. Styrene-butadiene, elastomer, thermoplastic rubber, or PVC could be used to form piston 28, with PVC being the preferred material. The resilient cap 22 is also preferably made of PVC or the like.

The forward face 30 of piston 28 defines the primary chamber 26 while the frusto-conical rearward face 32 of piston 28 is in contact with a compression spring 34. The spring 34 is contained within a secondary chamber 36 established partially by the piston 28. The secondary chamber 36 extends into the tail section 16. The secondary chambers 36 in the front and tail sections 14, 16 are axially aligned and are in fluid communication with each other.

In the preferred embodiment, the tail section 16 includes a forward fin spanner 15, a rearward fin spanner 19, and four equally-spaced fins 17 extending longitudinally from one spanner to the other. Of course, other fin configurations could be used.

The secondary chambers 36 are preferably vented by four vent holes 38 in the tail section 16. These vent holes 38 are preferably molded into the tail section 16, eliminating the need for drilling following the injection molding process. There are preferably four vent holes formed between the four fins 17. Therefore, if one vent hole 38 should be partially or completely plugged, there would still be adequate venting of the secondary chambers 36 via the remaining vent holes 38.

The dart 10 can be fired by a wide variety of guns, including compressed gas (e.g., $C0_2$) or air guns and chemical explosion guns. For example, a standard Palmer gun could be used. The dart 10 is particularly useful for long distance injections due to its superior aerodynamic design. Use of the symmetrical barb 24 in itself results in improved aerodynamic characteristics of the dart 10.

FIG. 4 illustrates the dart 10 lodged in an animal's hide after the liquid has been injected. The tip 20 of needle 12 has pierced both the cap 22 and the animal's hide, and the needle 12 has lodged therein. Once the cap 22 has been pierced, the pressurized liquid within primary chamber 26 is forced into the animal by the action of the compressed spring 34 on the piston 28. The vent holes 38, in communication with the secondary chambers 36, allow complete and controlled emptying of the primary chamber 26. The barb 24 maintains the needle 12 in the animal's hide for a period of time sufficient to allow complete emptying of the primary chamber 26.

Once the primary chamber 26 is empty, the needle 12 harmlessly disengages from the animal. The barb 24 has been designed to be sufficiently aggressive to hold the needle in the animal long enough to allow all of the liquid in the primary chamber 26 to flow through the needle 12 into the animal. The barb 24 is not so aggressive that the needle 12 permanently lodges within the animal, however. The spent dart can thereafter be sterilized, refilled and reused. The dart 10 is filled by simply forcing liquid through the needle 12 into the primary chamber 26. As the primary chamber fills, the piston 28 moves toward the secondary chamber 36 and compresses spring 34. Once the primary chamber is completely filled, the needle 12 is capped. Alternatively, the piston is placed in a preselected position so as to establish, for example, a 2 cc primary chamber volume; the primary chamber 26 is filled; the needle 12 is capped; and a compressed spring is positioned behind the piston 28 within the secondary chamber to pressurize the primary chamber 26. In either event, when the projectile strikes an animal, the needle 12 penetrates the resilient cap and the animal's hide, and the pressurized liquid in the primary chamber 26 flows through the needle 12 into the animal in a controlled manner.

It should be emphasized that the present invention is not limited to any particular components, materials or configurations, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having the specific configurations and shapes as presented herein. All alternative modifications and variations of the present invention which fall within the spirit and broad scope of the appended claims are included.

What is claimed is:

1. A dart for injecting a liquid into an animal, comprising:

(a) a hollow body comprising a forward section and a tail section having a plurality of longitudinal fins, the forward section including a narrow shaft portion extending from the forward section of the hollow body, wherein the shaft portion forms a barb thereon, the barb being circumferential and substantially annular in shape;

(b) a hollow needle extending through and fixed within the shaft portion;

(c) a piston having front and rear faces slidably constrained within the body, wherein a primary chamber suitable for containing the liquid is formed by the body and the front face of the piston, wherein a secondary chamber is formed by the body and the rear face of the piston, there being a plurality of vent holes which vent the secondary chamber; and (d) resilient means in operative contact with the piston for urging the piston toward the primary chamber, wherein when the primary chamber is charged with a liquid and when the needle enters the animal, the resilient means causes the piston to force the liquid through the needle into the animal, and the vent holes permit the free government of the piston.

2. The injecting dart of claim 1, wherein the needle is press fit into the shaft portion for interconnection thereof.

3. The injecting dart of claim 2, wherein the barb is of one piece construction with the shaft portion.

4. The injecting dart of claim 3, wherein the tail section comprises four fins and forms four vent holes.

5. The injecting dart of claim 1, wherein the needle has tip and base portions, wherein the base portion of the needle is in operative contact with the primary chamber, and the needle tip is curved so as to prevent plugging of the needle as it enters the animal.

6. The injecting dart of claim 1, wherein the shaft portion has a forward end and a rear end, and the barb is substantially midway between the forward end and rear end.

7. The injecting dart of claim 6, wherein the barb extends radially from the outside diameter of the shaft portion between approximately 0.001 and 0.10 inch.

8. A dart for injecting liquid into an animal, comprising:

(a) a hollow body comprising a forward section and a tail section, wherein the tail section comprises a forward fin spanner, a rearward fin spanner and four equally spaced fins extending longitudinally from the forward fin spanner to the rearward fin spanner, wherein a narrow shaft portion extends from the forward section of the hollow body, wherein the shaft portion forms a barb thereon, the barb being circumferential and substantially annular in shape;

(b) a hollow needle having tip and base portions, wherein the needle extends through the shaft portion and is fixed within the shaft portion and the needle tip is curved so as to prevent plugging of the needle as it enters the animal;

(c) a piston having front and rear faces slidably constrained within the forward section of the body, wherein a primary chamber suitable for containing the liquid is formed by the body and the front face of the piston and a secondary chamber is formed by the body and the rear face of the piston, and wherein four vent holes are formed between adjacent fins;

(d) a cap suitable for covering the tip of the needle to retain the liquid in the primary chamber; and (e) a spring housed within the secondary chamber in operative contact with the rear face of the piston for moving the piston toward and into the primary chamber wherein when the primary chamber is charged with liquid and the dart strikes the animal the needle penetrates the cap and the spring causes the piston to force the liquid through the needle into the animal, and the vent holes permit free movement of the piston.

9. The injecting dart of claim 8, wherein the needle is press fit into the shaft portion for interconnection thereof.

10. The injecting dart of claim 9, wherein the barb is of one piece construction with the shaft portion.

11. The injecting dart of claim 8, wherein the forward section and tail section are removably interconnected at a threaded joint.

12. The injecting dart of claim 11, wherein the tail section comprises four fins and forms four vent holes.

13. The injecting dart of claim 8, wherein the needle has tip and base portions, wherein the base portion of the needle is in operative contact with the primary chamber, and the needle tip is curved so as to prevent plugging of the needle as it enters the animal.

14. The injecting dart of claim 8, wherein the shaft portion has a forward end and a rear end, and the barb is substantially midway between the forward end and rear end.

15. A dart for injecting liquid into an animal, comprising:

(a) a hollow body suitable for containing the liquid comprising a forward section and a tail section;

(b) a shaft portion integral with and extending from the forward section of the body, wherein the shaft portion and forward section of the body are molded from a single piece of plastic, the shaft portion including a barb which is of one piece construction with the shaft portion, the barb being hollow, circumferential, and substantially annular in shape;

(c) a hollow needle which extends within the shaft portion and is fixed within the shaft portion; and (d) injection means, responsive to impact of the dart with the animal, contained within the hollow body for forcing the liquid out of the hollow body and through the needle into the animal.

16. A dart for injecting a liquid into an animal, comprising:

(a) a hollow body comprising a forward section and a tail section in threaded connection thereto, wherein the tail section comprises a plurality of fins extending a portion of the way from the front end of the tail section to the rear end of the tail section;

(b) a shaft portion integral with and extending from the forward section of the body, wherein the shaft portion and forward section of the body are molded from a single piece of plastic, the shaft portion including a barb which is of one piece construction with the shaft portion, the barb being circumferential and substantially annular in shape;

(c) a hollow needle which extends within the shaft portion and is fixed within the shaft portion; and (d) a piston having front and rear faces slidably constrained within the body, wherein a primary chamber suitable for containing the liquid is formed by the body and the front face of the piston and a secondary chamber is formed by the body and the rear face of the piston, and wherein a plurality of vent holes are formed for venting the secondary chamber; and (e) resilient means in operative contact with the piston for urging the piston toward the primary chamber, wherein when the primary chamber is charged with the liquid and when the needle enters the animal, the resilient means causes the piston to force the liquid through the needle into the animal, and the vent holes permit the free movement of the piston.

* * * * *